US005944117A

United States Patent [19]

Burkholder et al.

[11] Patent Number: 5,944,117

[45] Date of Patent: Aug. 31, 1999

[54] FLUID ACTUATED IMPACT TOOL

[75] Inventors: Titus H. Burkholder, Lititz; Duane H. Fetter, Bedford, both of Pa.

[73] Assignee: Eastern Driller's Manufacturing Co., Inc., Lancaster, Pa.

[21] Appl. No.: 08/852,623

[22] Filed: May 7, 1997

[51] Int. Cl.[6] ..... B25D 9/00

[52] U.S. Cl. ..... 173/91; 173/15; 173/17

[58] Field of Search ..... 173/91, 15, 17, 173/19; 175/51

[56] References Cited

U.S. PATENT DOCUMENTS

| | | | |
|---|---|---|---|
| 3,958,645 | 5/1976 | Curington | 173/17 |
| 4,030,554 | 6/1977 | Kammerer, Jr. et al. | 173/17 |
| 4,084,646 | 4/1978 | Kurt | 173/17 |
| 4,530,408 | 7/1985 | Toutant | 173/17 |
| 4,706,764 | 11/1987 | Hughes | 175/320 |
| 4,821,812 | 4/1989 | Ditzig | 173/17 |
| 5,301,758 | 4/1994 | Jenne | 173/91 |
| 5,337,837 | 8/1994 | Wentworth et al. | 173/19 |
| 5,465,797 | 11/1995 | Wentworth et al. | 173/91 |
| 5,603,383 | 2/1997 | Wentworth et al. | 173/91 |
| 5,680,904 | 10/1997 | Patterson | 173/91 |

*Primary Examiner*—Lee W. Young
*Assistant Examiner*—A. Dexter Tugbang
*Attorney, Agent, or Firm*—Panitch Schwarze Jacobs & Nadel, P.C.

[57] ABSTRACT

An improved fluid actuated percussive impact tool of the valveless type adapted for down hole drilling is provided. The impact tool includes a casing, a back head, a distributor located at a first end of the casing, and an impact receiving device located at a second end of the casing. A chamber is located between the distributor and the impact receiving device. A cylinder sleeve is located in the chamber adjacent to the distributor. A first pressurized fluid passage is located between the casing and the cylinder sleeve for passing pressurized fluid from the distributor to the chamber. A piston is located in the chamber for reciprocating axial movement. Axially extending ports are located on at least one of the piston, the cylinder sleeve and the casing in the chamber for alternately supplying pressurized fluid to upper and lower chamber portions. An exhaust bore is provided in fluid communication with the chamber which selectively exhausts pressurized fluid from the upper and lower chamber portions to thereby reciprocate the piston between a first position wherein the first end of the piston is in contact with the impact receiving device and a second position wherein the second end is in proximity to the distributor to impart blows on the impact receiving device. The piston has an elongated generally cylindrical body and a reduced diameter neck forming a first lifting surface which is offset a first distance from the first end of the piston. A first axially extending port is located on the piston between the first and second sealing surfaces. The intersection of the first sealing surface and the first axially extending port defines a port opening timing location located a second distance from the first end of the piston. The first distance on the impact receiving device is at least 40% of second distance such that the frequency of blows per minute is increased by at least 10 percent.

8 Claims, 2 Drawing Sheets

FLUID ACTUATED IMPACT TOOL

BACKGROUND OF THE INVENTION

The present invention relates to impact tools for use in drilling operations, and more particularly, to fluid actuated percussive drilling equipment such as used in rock drilling and similar operations.

Down hole well drilling, for oil, gas or water, requires a specially designed drill apparatus, which can be used in applications where the diameter of the drill body is less than the drill bit diameter. The drill apparatus must provide high energy output, simplicity, and reliability in order to provide economical operation, and must also be able to withstand the abrasive environment as well as the continuous impact loading required for cutting through rock.

Pressurized fluid actuated impact tools and in particular pneumatic down-the-hole rock drills of this type are generally known, as disclosed in U.S. Pat. No. 4,084,646, the disclosure of which is incorporated herein by reference. This patent discloses a drill having only a single moving part and all valving of the pressurized fluid is accomplished by interior and exterior porting on the piston and the casing. In such known drills, the moving part comprises a piston which strikes directly on the percussive bit. The known devices utilize a piston weighing between 45 and 50 pounds which is reciprocated at a frequency of approximately 1,500–1,800 blows per minute by pressurized air, generally provided at 250 to 350 psi.

The speed at which the drill bit progresses through the rock is dependent upon many factors, including the frequency of the piston movement for impacting on the bit as well as the force with which the piston strikes the bit. The known pneumatic down-the-hole rock drills have been operated successfully for least 20 years. However, in order to reduce the amount of time on site during drilling operations it would desirable to provide an improved drill apparatus which could drill through rock at a higher speed.

BRIEF SUMMARY OF THE INVENTION

Briefly stated, the present invention provides an improved fluid actuated percussive impact tool of the valveless type adapted for down hole drilling. The impact tool includes a casing, a back head, a distributor located at a first end of the casing, and an impact receiving device located at a second end of the casing. A chamber is located between the distributor and the impact receiving device. A cylinder sleeve is located in the chamber adjacent to the distributor. A first pressurized fluid passage is located between the casing and the cylinder sleeve for passing pressurized fluid from the distributor to the chamber. A piston is located in the chamber for reciprocating axial movement. The piston has a first end facing the impact receiving device with a first sealing surface in sliding contact with the casing. The piston also has a second end facing the distributor and in sliding contact with the cylinder sleeve. The second end of the piston includes a second sealing surface which sealingly engages the cylinder sleeve. The chamber includes a lower chamber portion which is located between the piston and the impact receiving device with an upper chamber portion being located between the second end and the distributor. Axially extending ports are located on at least one of the piston, the cylinder sleeve and the casing in the chamber for alternately supplying pressurized fluid to the upper and lower chamber portions. An exhaust bore is provided in fluid communication with the chamber which selectively exhausts pressurized fluid from the upper and lower chamber portions to thereby reciprocate the piston between a first position wherein the first end of the piston is in contact with the impact receiving device, and a second position wherein the second end of the piston is in proximity to the distributor to impart blows on the impact receiving device. The improvement comprises an improved piston having an elongated generally cylindrical body and a reduced diameter neck which forms a first lifting surface which is offset by a first distance from the first end of the piston. A first axially extending port is located on the piston between the first and second sealing surfaces. The intersection of the first sealing surface and the first axially extending port defines a port opening timing location located a second distance from the first end of the piston. The first distance is at least 40% of second distance.

In another aspect, the present invention provides a percussive drill apparatus for down hole drilling which is adapted to be supported and driven by a drill string and actuated by a fluid pressure source. The percussive drill apparatus includes a casing having an upper end and a lower end. A coupling is disposed at the upper end of the casing for a connection to the pressurized fluid source. A distributor is located within the casing proximal to the coupling and includes a passageway therethrough for transmitting pressurized fluid from the coupling. A cylinder sleeve is disposed within the casing proximal to the distributor. A bit is located at the lower end of the casing. A chamber having a generally cylindrical configuration, a lesser inner diameter, and a greater inner diameter, with the greater inner diameter being formed by the casing and the lesser inner diameter being formed the cylinder housing, is provided with the first end being enclosed by the bit and the second end being enclosed by the distributor. A first fluid passageway is located between the cylinder sleeve and the casing for transmitting pressurized fluid from the distributor to the chamber. A reciprocating piston is disposed within the chamber, with the piston having a first end disposed toward the first end of the chamber, with a first sealing surface adjacent to the first end of the piston, and a second end of the piston disposed toward the second end of the chamber, with a second sealing surface located adjacent to the second end of the piston. A hammer surface is provided on the first end of the piston for imparting multiple blows to the bit. A reduced diameter neck is located adjacent to the first end of the piston which forms a first lifting surface which is offset from the first end of the piston by a first distance. A first axially extending port is located on the piston between the first and second sealing surfaces and is adapted to alternatingly permit pressurized fluid to pass from the first fluid passageway into a lower chamber portion between the piston and the first end of the chamber, as the first end of the piston approaches a first position in proximity to the bit. An upper chamber portion is located between the second end of the piston and the second end of the chamber. The intersection of the first axially extending port and the first sealing surface defines a timing location on the piston for passing pressurized fluid to the lower chamber portion. The timing location is offset from the first end of the piston by a second distance. The first distance is at least 40% of the second distance to form an enlarged lower chamber portion between the reduced diameter neck of the piston and the casing. The pressurized fluid in the enlarged lower chamber portion acts as an increased energy fluid spring to increase a frequency of piston reciprocation providing an increased number of blows per minute on the impacting device. An exhaust bore is provided for venting pressurized fluid in the upper chamber portion as the piston moves toward the first position and for venting pressurized fluid in the lower chamber portion as the piston moves toward the second position.

In another aspect, the present invention provides an improved fluid actuated percussive drill apparatus of the valveless type which is adapted for down hole drilling. The drill apparatus includes a casing, a back head, a distributor located at a first end of the casing, and an impact receiving device located at a second end of the casing. A chamber is located between the distributor and the impact receiving device. A cylinder sleeve is located in the chamber adjacent to the distributor. A first pressurized fluid passage is located between the casing and the cylinder sleeve for passing pressurized fluid from the distributor to the chamber. A piston is located in the chamber for reciprocating axial movement. The piston has a first end facing the impact receiving device with a first sealing surface in sliding contact with the casing, and a second end facing the distributor, with the second end of the piston including a second sealing surface which sealingly engages the cylinder sleeve. The chamber includes a lower chamber portion located between the piston and the impact receiving device, and an upper chamber portion located between the second end of the piston and the distributor. Axially extending ports are located on the piston and the casing in the chamber for alternately supplying pressurized fluid to the upper and lower chamber portions. An exhaust bore is provided in fluid communication with the chamber which selectively exhausts pressurized fluid from the upper and lower chamber portions to thereby reciprocate the piston between a first position wherein the first end of the piston is in contact with the impact receiving device and a second position wherein the second end of the piston is in proximity to the distributor to impart blows on the impact receiving device. The improvement comprises an enlarged lower chamber portion when the piston is in the first position formed by least one of a reduced diameter neck on the piston, which forms a first lifting surface which is offset a first distance from the first end of the piston, and an enlarged circumferential axially extending port recess which extends a third distance in the casing below the lifting surface when the piston is in the first position. The first sealing surface extends a second distance from the first end of the piston. The third distance being at least 40% of the second distance. Pressurized fluid in the enlarged annular lower chamber acts as an increased energy fluid spring to increase a frequency of piston reciprocation and provide an increased number of blows per minute on the impact receiving device.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
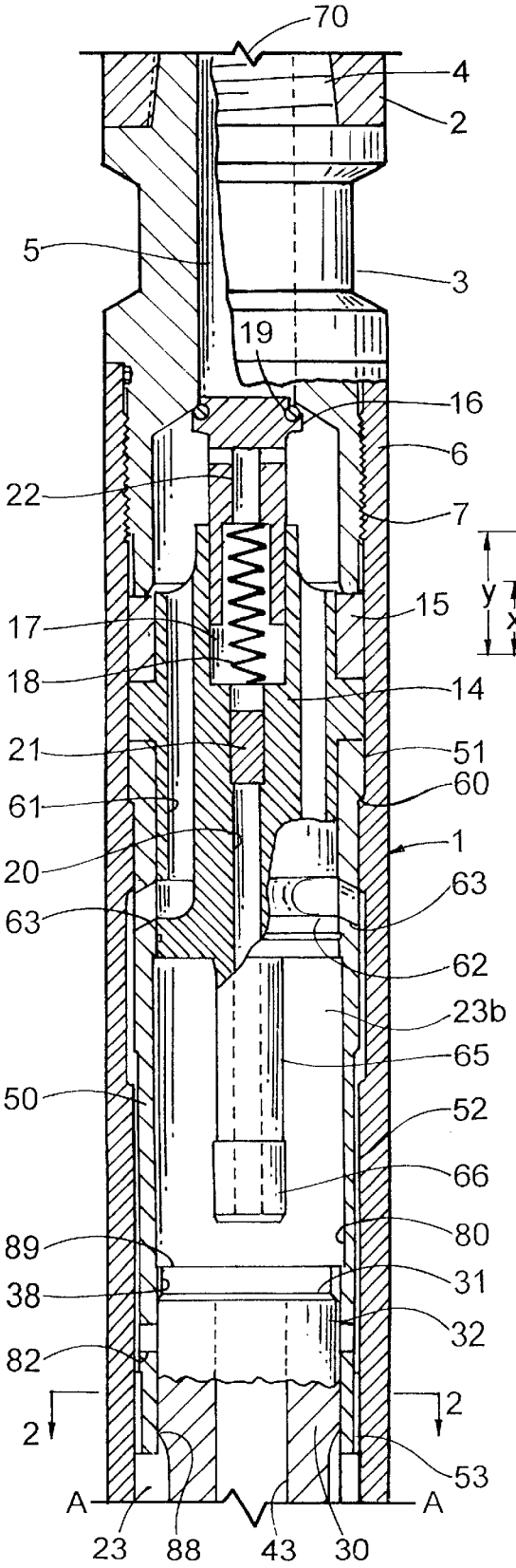
FIG. 1 is a longitudinal cross-sectional view of the rear part of a fluid actuated percussive impact tool in accordance with the present invention.

Certain terminology is used in the following description for convenience only and is not considered limiting. The words "right," "left," "lower" and "upper" designate directions in the drawings to which reference is made. The words "inwardly" and "outwardly" refer to directions toward and away from, respectively, the geometric center of the impact tool 1, and designated parts thereof. The terminology includes the words specifically mentioned above, derivatives thereof and words of similar import.

Referring to the drawings, wherein like numerals indicate like elements throughout, there is shown in FIGS. 1, 1A and 2–6, an improved fluid actuated percussive impact tool 1 which is preferably an improved fluid actuated percussive drill apparatus of the valveless type adapted for down hole drilling. The drill 1 is adapted to be suspended in a hole by means of an appropriate drill string 2. The drill 1 is provided with a back head coupling 3 which couples the drill string 2 to the remainder of the drill body. The back head coupling 3 includes a mating threaded section 4 for connection to the drill string 2. A center bore 5 is provided through the back head coupling 3 for passing pressurized fluid from the drill string 2 to the remainder of the drill.

The impact tool or drill 1 includes a casing 6 which is preferably threadedly engaged by means of casing thread 7 to the back head coupling 3. The casing 6 is preferably symmetrically machined so that it can be reversed end-to-end to provide for increased life by reversing the casing 6 when one side becomes too worn.

A distributor 14 is disposed within the casing 6 in proximity to the back head coupling 3. The distributor 14 slides into the casing 6 when the back head coupling 3 is removed. A collar 15 serves to retain the distributor 14 in place. The distributor 14 is provided with a check valve 16 which serves to prevent reverse flow of pressurized fluid and/or foreign particulate matter back into the drill string 2. The check valve 16 is disposed within a bore 17 located within the distributor 14. A spring 18 biases the check valve 16 towards the closed position in contact with the central bore 5 of the back head coupling 3. An O-ring seal 19 is provided between the check valve 16 and the back head coupling 3. The check valve 16 is further provided with a T-shaped passageway 22 which provides access for pressurized fluids to the bore 17.

An axially bored passageway 20 is provided in the distributor 14 for directing the pressurized fluid directly through the distributor 14 to the remainder of the impact apparatus 1 in certain applications as described in more detail below. A series of longitudinal bore holes 61 are also provided in the distributor 14 which end in a circumferential undercut 62 adjacent to the lower end of the distributor 14.

The flow of pressurized fluid, such as air, through the passageway 20 in the distributor 14 is regulated by means of an orifice plug 21. In the presently preferred embodiment, the orifice plug 21 is solid and no pressurized fluid flows through the axially bore passageway 20. However, in some types of rock or soil conditions, it is desirable to provide a continuous or increased purge of pressurized fluid through the impact tool 1. Accordingly, the plug 21 can be removed or provided with a calibrated drill bore in order to regulate the passage of pressurized fluid.

Figure 1A:
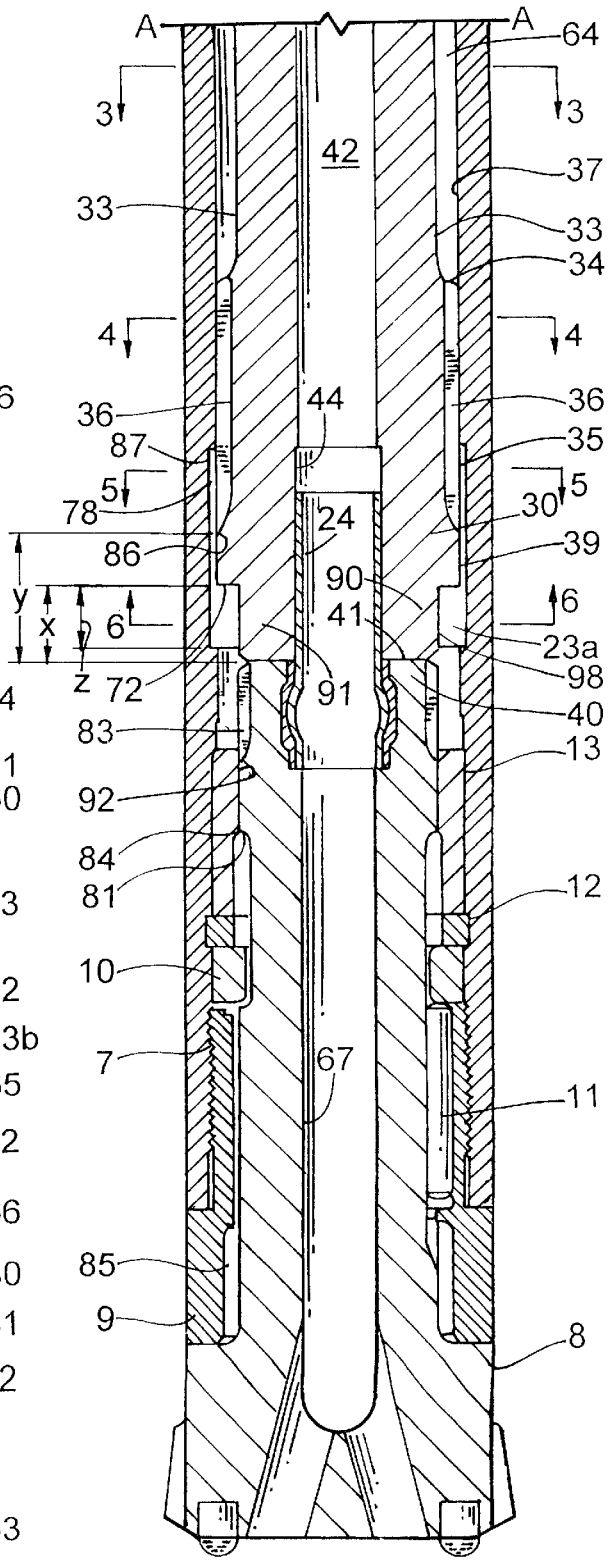
FIG. 1A is a continuation of the forward part of the fluid actuated percussive impact tool of FIG. 1 which continues from match line A—A in FIG. 1, and illustrates the end of the piston, the casing and a percussive drill bit.
Figure 2:
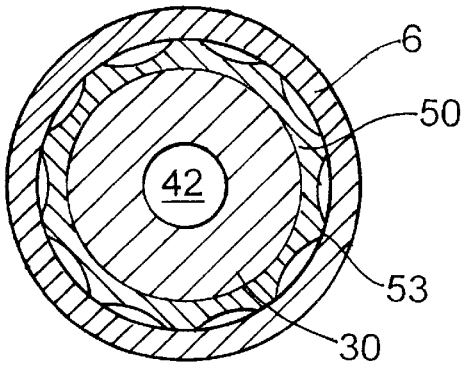
FIG. 2 is a cross-sectional view of the impact tool taken along lines 2—2 of FIG. 1.
Figure 3:
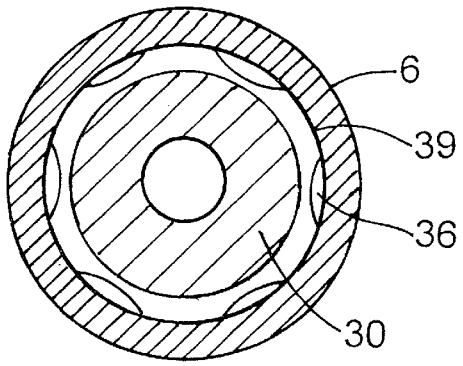
FIG. 3 is a cross-sectional view of the impact tool taken along lines 3—3 of FIG. 1A.
Figure 5:
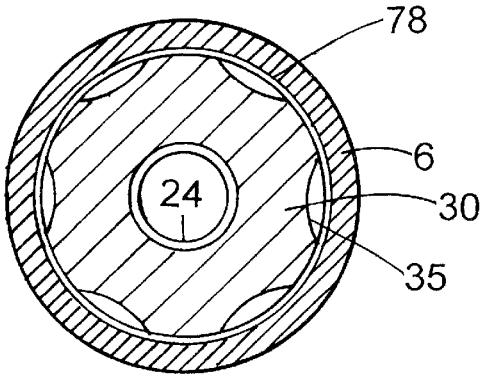
FIG. 5 is a cross-sectional view of the impact tool take along lines 5—5 in FIG. 1A.
Figure 4:
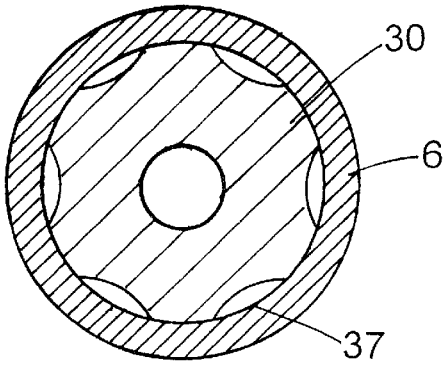
FIG. 4 is a cross-sectional view of the impact tool taken along lines 4—4 in FIG. 1A.
Figure 6:
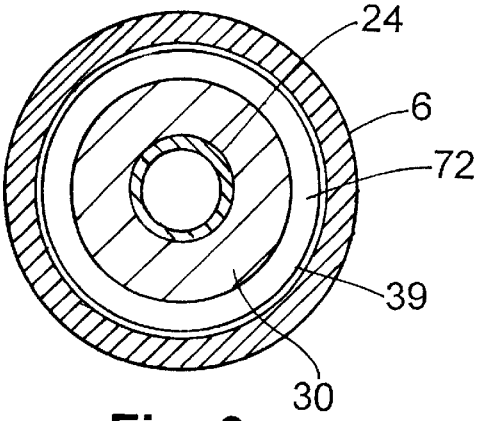
FIG. 6 is a cross-sectional view taken along line 6—6 in FIG. 1A.

As shown in FIG. 1A, an impact receiving device, such as a percussive drill bit 8 is mounted at a second end of the casing 6. The percussive drill bit 8 is located in a supporting chuck 9. The supporting chuck 9 is threadedly engaged with the casing 6 at its second end by means of a second casing thread 7. The percussive drill bit 8 is mounted for restricted axial movement within the chuck 9. The downward axial excursion of the drill bit 8 is limited by a split retaining ring 10. The percussive drill bit is driven in the rotary direction by the drill string 2, the back head coupling 3, the casing 6, the chuck 9 and a drive pin 11 located within the chuck 9. One preferred drive system is described in detail in U.S. Pat. No. 3,517,754, which is incorporated herein by reference as if fully set forth. A compression ring 12 and a spacer ring 13 complete the mounting and guiding elements for the percussive drill bit 8.

A chamber 23 is located between the distributor 14 and the impact receiving device, which is preferably the drill bit 8. A cylindrical sleeve 50 is located within the casing 6 in proximity to the distributor 14. The cylinder sleeve 50 is slidably disposed within the casing 6 when the distributor 14, collar 15 and the back head coupling 3 are removed. Axial movement in the casing 6 is prevented by means of an increased diameter portion or boss 51 which contacts a ridge 60 in the casing 6. The cylindrical sleeve 50 includes a plurality of ports 63. One side of the distributor 14 is seated within the cylindrical sleeve 50 such that the undercut 62 is aligned with the ports 63. A first pressurized fluid passageway 52 is located between the cylindrical sleeve 50 and the casing 6. The passageway 52 may be annular or may be formed by annular segments between the sleeve 50 and the casing 6. Pressurized fluid can pass through the longitudinal bore holes 61 in the distributor 14 to undercut 62 adjacent to the lower end of the distributor 14, through the ports 63 in the cylindrical sleeve 50, and into the first passageway 52.

Still with reference to FIGS. 1 and 1A, a piston 30 is located within the casing 6. The piston 30 has first end 40 which is preferably a hammer surface facing the impact receiving device 8 and a first sealing surface 39 that is in sliding contact with a portion of the casing 6 when the piston 30 is raised from a first, lowermost position as shown in FIG. 1*a*. The piston 30 includes a second end 31 and a second sealing surface 32 which sealingly engages the cylinder sleeve 50 when the piston 30 is in the lower portion of its travel, as illustrated in FIGS. 1 and 1A. The chamber 23 includes a lower chamber portion 23*a* between the piston 30 and the impact receiving device 8 and an upper chamber portion 23*b* between the second end 31 of the piston 30 and the distributor 14.

Axially extending ports are located on at least one of the piston 30, the cylinder sleeve 50, and the casing 6 in the chamber 23 for alternately supplying pressurized fluid to the upper and lower chamber portions 23*a*, 23*b*. The piston 30 preferably includes a reduced diameter portion 33 adjacent to the second sealing surface 32 and between the first and second sealing surfaces 32, 39 which acts as a port for directing pressurized fluid to the upper chamber portion 23*b* when the piston 30 is in the upper part of its travel. Preferably, axial porting slots 36 are provided on the large diameter portion of the piston 30 starting an appreciable distance from the first end 40 which end at a shoulder 34 adjacent to the reduced diameter portion 33 of the piston 30. The axial porting slots 36 provide a passageway for pressurized fluid to move axially along the outside portion of the piston 30 when the piston 30 is in the lower portion of its travel. The first and second sealing surfaces 39, 32 serve as seals against the flow of pressurized fluid when contact with the internal surfaces of the cylinder sleeve 50 or the casing 6 is made.

The first end 40 of the piston 30 is used for imparting force on an anvil 41 of the impact receiving device 8. The piston 30 includes an axial bore 42 with an internal sealing surface 43 at its upper end and internal sealing surface 44 at its lower end. The distributor 14 is provided with an exhaust rod 65 which has an enlarged head and sealing surfaces 66. When the piston 30 has moved sufficiently towards the distributor 14 to engage the exhaust rod 65, the enlarged head and sealing surfaces 66 and the internal sealing surface 43 cooperate to close off the axial bore 42 from any pressurized fluid that may be supplied to the upper chamber portion 23*b*.

The percussive drill bit 8 is provided with an exhaust tube 24 which cooperates with the sealing surface 44 of the piston 30 to prevent pressurized fluid from entering the exhaust bore 67 of the percussive drill bit 8 when the piston 30 is at the lower portion of its travel. Circumferential grooves or undercuts 78, 80 in the casing 6 and the cylinder sleeve 50 cooperate with the first and second sealing surfaces 39, 31 of the piston 30 depending on its position to either pass or prevent the flow of pressurized fluid to the upper and lower chamber portions 23*a*, 23*b* formed at the opposite ends of the piston 30. The axially extending ports located on at least one of the piston 30, the cylinder sleeve 50 and the casing 6 in the chamber 23 alternately supply pressurized fluid to the upper and lower chamber portions 23*a*, 23*b*, and the exhaust bores 42, 67 in fluid communication with the chamber 23 selectively exhaust the pressurized fluid from the upper and lower chamber portions 23*a*, 23*b* to thereby reciprocate the piston 30 between the first position, shown in FIGS. 1 and 1A wherein the first end 40 is in contact the impact receiving device 8 and a second position (not shown) wherein the second end 31 is in proximity to the distributor 14.

Preferably, 250–350 psi fluid, such as air, enters the drill at inlet 70 in the back head coupling 3 from the drill string 2. The fluid pressure forces the check valve 16 to move forward against the spring 18 which holds it on its seat when no fluid pressure is applied to the drill 1. The fluid passes around the check valve 16 through the distributor 14 via the longitudinal bores 61, to the undercut 62 in the distributor 14 where it passes through the ports 63 in the cylinder sleeve 50 into the first passageway 52 between the outside of the cylinder sleeve 50 and the inside of the casing 6. From here, the air moves into the chamber 23 between the reduced diameter portion 33 of the piston 30 and the casing 6. This provides an air reservoir space because there is always fluid pressure in the space between the reduced diameter portion 33 of the piston 30 and it is from this space that the pressurized fluid passes either to the lower chamber portion 23*a* or the upper chamber portion 23*b*.

When the piston 30 is in the lower portion of its travel, as shown in FIGS. 1 and 1A, air passes into the lower chamber portion 23*a* exerting a force on a first lifting surface 72 of the piston 30, as well as on the first end 40 of the piston 30. This drives the piston 30 upward as air continues to feed into the lower chamber portion 23*a* until a port opening timing location defined by edge 86, located at the intersection of the sealing surface 39 and the axial porting slots 36, passes shoulder 87 of the groove or undercut 78 in the inside of the casing 6. The first sealing surface 39 is then in sealing relation with the inside of the casing 6, shutting off air to the lower chamber portion 23*a*. The piston 30 continues to move upwards by virtue of its momentum and the expansion of air in the lower chamber portion 23*a*. As the piston 30 rises, the lower sealing surface 44 of the axial bore 42 of the piston 30 pulls off the end of the exhaust tube 24. The pressurized air in the lower chamber portion 23*a* then exhausts into the drill bit 8 and out into the exhaust bore 67.

As the piston 30 rises, the upper chamber portion 23*b* is sealed off as the sealing surface 43 of the piston 30 engages the lower end of the enlarged head and sealing surfaces 66 of the exhaust rod 65 of the distributor 14. As the second sealing surface 32 adjacent to the second end 31 of the piston 30 passes beyond the shoulder 89 of undercut 80 inside the cylinder sleeve 50, pressurized air passes into the upper chamber portion 23*a*. The pressurized air first stops the piston 30 in its upward travel and then reverses the piston 30 pushing downward at increasing velocity. Flow of pressurized fluid to the upper chamber portion 23*b* is shut off as the lower edge 88 of the second sealing surface passes the shoulder 89. The piston 30 continues to accelerate downwardly until the first sealing surface 39 of the piston 30 losses contact with the shoulder 87 of the interior surface 30 of the casing 6 at which point air re-enters the lower chamber portion 23*a*. However, the momentum and expanding pressurized fluid in the upper chamber portion 23*b* force the piston 30 downwardly to impact against the impact receiving device 8. The piston 30 rebounds somewhat after impact, and this plus the air re-entering the lower chamber portion 23*a* acting on the first lifting surface 72 and on the first end 40 of the piston 30 starts the next cycle.

In the known devices as exemplified by U.S. Pat. No. 4,084,646, the piston weighs 45 to 50 pounds and reciprocates at a frequency in the range of 1,500 to 1,800 blows per minute on the impact receiving device. However, in order to improve the performance of the fluid actuated percussive impact tool 1 in accordance with the present invention, the piston 30 is improved by including a reduced diameter neck 98 adjacent to the first end 40 of the piston 30. The reduced diameter neck 98 forms the first lifting surface 72 and at the same time enlarges the remaining area of the lower chamber portion 23*a* when the piston 30 is in the first position, shown in FIG. 1A, as well as reduces the weight of the piston by approximately one pound. The first lifting surface 72 is offset a first distance X from the first end 40 of the piston 30. The port opening timing location defined by edge 86 of the first sealing surface 39 is located a second distance Y from the first end 40 of the piston 30. Preferably, the first distance X for locating the first lifting surface 72 is at least 40 percent of the second distance Y, such that the frequency of blows per minute is at least 10 percent greater utilizing the improved piston 30 of the present invention, as compared to the previously known pistons used in connection with fluid actuated percussive impact tools. This provides a piston reciprocation frequency in the preferred embodiment of about 2000 blows per minute or more.

In the preferred embodiment, the first distance X is at least one inch and preferably approximately 1⅛ inches from the first end 40 of the piston 30 and the second distance Y is approximately two inches and more preferably 1.987 inches from the first end 40 of the piston 30.

The lifting surface 72 being located the first distance X from the first end 40 of the piston 30 also creates an enlarged lower chamber portion 23*a* when the piston 30 is in the first position shown in FIGS. 1 and 1A. The enlarged lower chamber portion 23*a* is formed by at least one of the reduced diameter neck on the piston 30 and an enlarged circumferential axially extending port recess, formed by the groove or undercut 78 in the casing 6, which extends a third distance Z in the casing 6 below the lifting surface 72 when the piston 30 is in the first position. The first sealing surface 39 extends the second distance Y from the first end 40 of the piston 30, and the third distance Z is preferably at least 40 percent of the second distance Y to provide an increased energy fluid spring based on the additional pressurized fluid in the enlarged lower chamber portion 23*a,* with the increased energy fluid spring increasing the frequency of piston 30 reciprocation and providing an increased number of blows per minute on the impact receiving device 8.

Preferably, the third distance Z is approximately one inch for a piston having a maximum outside diameter of approximately 4.43 inches and a length of approximately 16 inches, where the first distance is approximately 1⅛ inches and the second distance Y is approximately two inches.

Utilizing the improved fluid actuated percussive impact tool 1 of the present invention, which is preferably in the form of a percussive drill apparatus, improved drill cutting rates of 10 to 15 percent or more have been achieved which reduces the time and costs of drilling operations. This improvement has been achieved utilizing the improved piston 30 of the present invention in conjunction with standard parts from a CF6 down the hole drill from the assignee of the present invention, Eastern Drillers Manufacturing Co., Inc., Lancaster, Pa., and is believed to be capable of providing the same type of improved drilling rates on similar drills from other manufacturers.

It will be appreciated by those skilled in the art that changes could be made to the fluid actuated percussive impact tool 1 of the type described in conjunction with the preferred embodiment of the present invention by modifying the piston and/or casing to increase the available expansion energy of the pressurized fluid in the lower chamber portion to increase the without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An improved fluid actuated percussive impact tool of the valveless type adapted for down hole drilling comprising; a casing, a back head, a distributor located at a first end of the casing, an impact receiving device located at a second end of the casing, a chamber being located between the distributor and the impact receiving device, a cylinder sleeve located in the chamber adjacent to the distributor, a first pressurized fluid passage located between the casing and the cylinder sleeve for passing pressurized fluid from the distributor to the chamber, a piston located in the chamber for reciprocating axial movement, the piston having a first end facing the impact receiving device with a first sealing surface in sliding contact with the casing, and a second end facing the distributor and in sliding contact with the cylinder sleeve, the second end of the piston including a second sealing surface which sealingly engages the cylinder sleeve, the chamber including a lower chamber portion located between the piston and the impact receiving device and an upper chamber portion located between the second end of the piston and the distributor, axially extending ports located on at least one of the piston, the cylinder sleeve and the casing in the chamber for alternately supplying pressurized fluid to the upper and lower chamber portions, and an exhaust bore in fluid communication with the chamber which selectively exhausts pressurized fluid from the upper and lower chamber portions to thereby reciprocate the piston between a first position wherein the first end of the piston is in contact with the impact receiving device and a second position wherein the second end of the piston is in proximity to the distributor to impart blows on the impact receiving device, wherein the improvement comprises:

an improved piston having an elongated generally cylindrical body and a reduced diameter neck which forms a first lifting surface which is offset by a first distance from the first end of the piston, and a first axially extending port located on the piston between the first and second sealing surfaces, the intersection of the first sealing surface and the first axially extending port defining a port opening timing location located a second distance from the first end of the piston, the first distance being at least 40% of the second distance to form an enlarged lower chamber portion when the piston is in the first position.

2. The impact tool of claim 1 wherein the first distance is at least one inch.

3. The impact tool of claim 1 wherein the first distance is approximately 1⅛ inches from the first end of the piston.

4. A percussive drill apparatus for down hole drilling adapted to be supported and driven by a drill string and actuated by a fluid pressure source, the percussive drill apparatus comprising;

a casing having an upper end and a lower end;

a coupling disposed at the upper end of the casing for connection to a pressurized fluid source;

a distributor disposed within the casing proximal to the coupling and having a passageway therethrough for transmitting pressurized fluid from the coupling;

a cylinder sleeve disposed within the casing proximal to the distributor;

a bit disposed at the lower end of the casing;

a chamber having a generally cylindrical configuration, a lesser inner diameter, a greater inner diameter, the greater inner diameter formed by the casing, the lesser inner diameter formed by the cylinder housing, a first end enclosed by the bit, and a second end enclosed by the distributor;

a first fluid passageway disposed between the cylinder sleeve and the casing for transmitting pressurized fluid from the distributor to the chamber;

a reciprocating piston disposed within the chamber, the piston having a first end disposed toward the first end of the chamber with a first sealing surface adjacent to the first end of the piston, and a second end disposed toward the second end of the chamber with a second sealing surface adjacent to the second end of the piston;

a hammer surface on the first end of the piston for imparting multiple blows to the bit;

a reduced diameter neck adjacent to the first end of the piston forming a first lifting surface which is offset from the first end of the piston by a first distance;

a first axially extending port located on the piston between the first and second sealing surfaces, and adapted to alternatingly permit pressurized fluid to pass from the first fluid passageway into a lower chamber portion between the piston and the first end of the chamber, as the first end of the piston approaches a first position in proximity to the bit, and into an upper chamber portion between the second end of the piston and the second end of the chamber as the piston approaches a second position, the intersection of the first axially extending port and the first sealing surface defining a first timing location on the piston for passing pressurized fluid to the lower chamber portion, the first timing location being offset from the first end of the piston by a second distance, the first distance being at least 40% of the second distance to form an enlarged lower chamber portion between the reduced diameter neck and the casing when the piston is in the first position, the pressurized fluid in the enlarged lower chamber portion acting as an increased energy fluid spring to increase a frequency of piston reciprocation providing an increased number of blows per minute on the impact receiving device; and an exhaust bore for venting pressurized fluid in the upper chamber portion as the piston moves toward the first position and for venting pressurized fluid in the lower chamber portion as the piston moves toward the second position.

5. The apparatus of claim 4 wherein the first distance is at least one inch.

6. The apparatus of claim 4 wherein the first distance is at about 1⅛ inches.

7. An improved fluid actuated percussive drill apparatus of the valveless type adapted for downhole drilling comprising; a casing, a back head, a distributor located at a first end of the casing, an impact receiving device located at a second end of the casing, a chamber being located between the distributor and the impact receiving device, a cylinder sleeve located in the chamber adjacent to the distributor, a first pressurized fluid passage located between the casing and the cylinder sleeve for passing pressurized fluid from the distributor to the chamber, a piston located in the chamber for reciprocating axial movement, the piston having a first end facing the impact receiving device with a first sealing surface in sliding contact with the casing, and a second end facing the distributor, the second end of the piston including a second sealing surface which sealingly engages the cylinder sleeve, the chamber including a lower chamber portion located between the piston and the impact receiving device and an upper chamber portion located between the second end and the distributor, axially extending ports located on the piston and the casing in the chamber for alternately supplying pressurized fluid to the upper and lower chamber portions, and an exhaust bore in fluid communication with the chamber which selectively exhausts pressurized fluid from the upper and lower chamber portions to thereby reciprocate the piston between a first position wherein the first end of the piston is contact with the impact receiving device and a second position wherein the second end of the piston is in proximity to the distributor to impart blows on the impact receiving device, wherein the improvement comprises:

an enlarged lower chamber portion when the piston is in the first position formed by at least one of a reduced diameter neck on the piston, which forms a first lifting surface which is offset a first distance from the first end of the piston, and an enlarged circumferential axially extending port recess which extends a third distance in the casing below the lifting surface when the piston is in the first position, the first sealing surface extending a second distance from the first end of the piston, the third distance being at least 40% of the second distance, the pressurized fluid in the enlarged lower chamber portion acts as an increased energy fluid spring to increase a frequency of piston reciprocation and provide an increased number of blows per minute on the impact receiving device.

8. The apparatus of claim 7 wherein the third distance is at least 1.25 inches or greater.

* * * * *